United States Patent [19]

Sikina, Jr.

[11] Patent Number: 4,835,542

[45] Date of Patent: May 30, 1989

[54] ULTRA-BROADBAND LINEARLY POLARIZED BICONICAL ANTENNA

[75] Inventor: Thomas V. Sikina, Jr., Acton, Mass.

[73] Assignee: Chu Associates, Inc., Littleton, Mass.

[21] Appl. No.: 141,567

[22] Filed: Jan. 6, 1988

[51] Int. Cl.[4] ..... H01Q 9/28

[52] U.S. Cl. ..... 343/802; 343/807; 343/808; 343/896

[58] Field of Search ..... 343/807, 809, 808, 806, 343/802, 896, 790, 792, 794, 820, 822, 899, 898, 908, 773, 747, 752

[56] References Cited

U.S. PATENT DOCUMENTS

| | | | |
|---|---|---|---|
| 2,563,243 | 8/1951 | Hills | 343/822 |
| 2,580,798 | 1/1952 | Kolster | 343/807 |
| 3,646,566 | 2/1972 | Neff | 343/808 |
| 3,942,180 | 3/1976 | Rannou et al. | 343/908 |

FOREIGN PATENT DOCUMENTS

| | | | |
|---|---|---|---|
| 524457 | 8/1940 | United Kingdom | 343/807 |
| 649944 | 2/1951 | United Kingdom | 343/773 |

*Primary Examiner*—William L. Sikes
*Assistant Examiner*—Michael C. Wimer
*Attorney, Agent, or Firm*—Rines and Rines, Shapiro and Shapiro

[57] ABSTRACT

A biconical antenna for ultra broad-band linear polarization operation in which capacitive sleeve VSWR tuning is effected between the apex regions of the two cones and zig-zag substantially V-shaped spokes are provided conically diverging from the cone base peripheries.

7 Claims, 2 Drawing Sheets

ULTRA-BROADBAND LINEARLY POLARIZED BICONICAL ANTENNA

BACKGROUND OF THE INVENTION

The present invention relates to broadband linearly polarized antennas, being more particularly directed to dipole-type structures especially adapted (though not exclusively) for vertical polarization use and generally of biconical configuration.

The art is replete with innumerable dipole and other linear polarization antenna structures, including those of biconical shape, for producing wide band frequency operation, including, for example, omni-directional dipole structures of the type disclosed in U.S. Pat. No. 4,598,296 of common assignee herewith--such systems being useful for broadband communications, surveilance in the electromagnetic frequency spectrum and other applications. For certain of these uses, the general antenna requirements call for a voltage standing wave ratio (VSWR) of 2.5:1 or less over a very broad range of frequencies, a stable and moderately broad radiation pattern in the elevational plane of the antenna, and an omnidirectional radiation pattern in the azimuthal plane. Antennas that satisfy this requirement are generally fixedtuned structures and heretofore have involved relatively complex structures and impedance-matching and adjusting mechanisms; and there are extensive compromises in the breadth of elevational pattern and the degree of omni-directionality over very broad frequency bands, particularly embracing the several GHz frequencies, above and below.

BRIEF DESCRIPTION OF THE INVENTION

An object of the present invention, accordingly, is to provide a new and improved ultra-broadband linearly polarized antenna of the generally biconical configuration that is simple in construction and is provided with inexpensive and highly effective tuning structures that enable improved uniform broadband performance.

A further object is to provide a novel biconical antenna structure of more general utility, as well.

Other and further objects will be explained hereinafter and are more particularly delineated in the appended claims.

In summary, however, the invention embodies a broadband frequency linearly polarized biconical antenna having, in combination, a pair of biconically disposed conductive cone elements the adjacent apex regions of which are connected to out-of-phase terminals of a feed transmission line and are spaced from one another by an insulating spacer; a conductive sleeve surrounding said spacer and capacitively coupling the cones while providing reactive tuning for the antenna affecting voltage standing wave ratios over at least a portion of the broadband of frequencies; and a crown of zig-zag conductive spokes conically diverging from the periphery of the cone base edges of each cone, providing a plurality of inverted V-shaped spokes acting inductively and with the gaps therebetween acting capacitively to present a frequency-dependent current distribution with an impedance that increases with increasing frequency in the band and causing the antenna current density to be restricted to the center of the antenna at the higher frequencies of said band and to be forced to substantially a cosine distribution at the lower frequencies thereof. Preferred and best mode embodiments and details are later delineated.

BRIEF DESCRIPTION OF THE DRAWINGS

The invention will now be explained in connection with the accompanying drawing, FIG. 1 of which is a side elevation of a preferred embodiment.

DETAILED DESCRIPTION OF THE INVENTION

Figure 1:
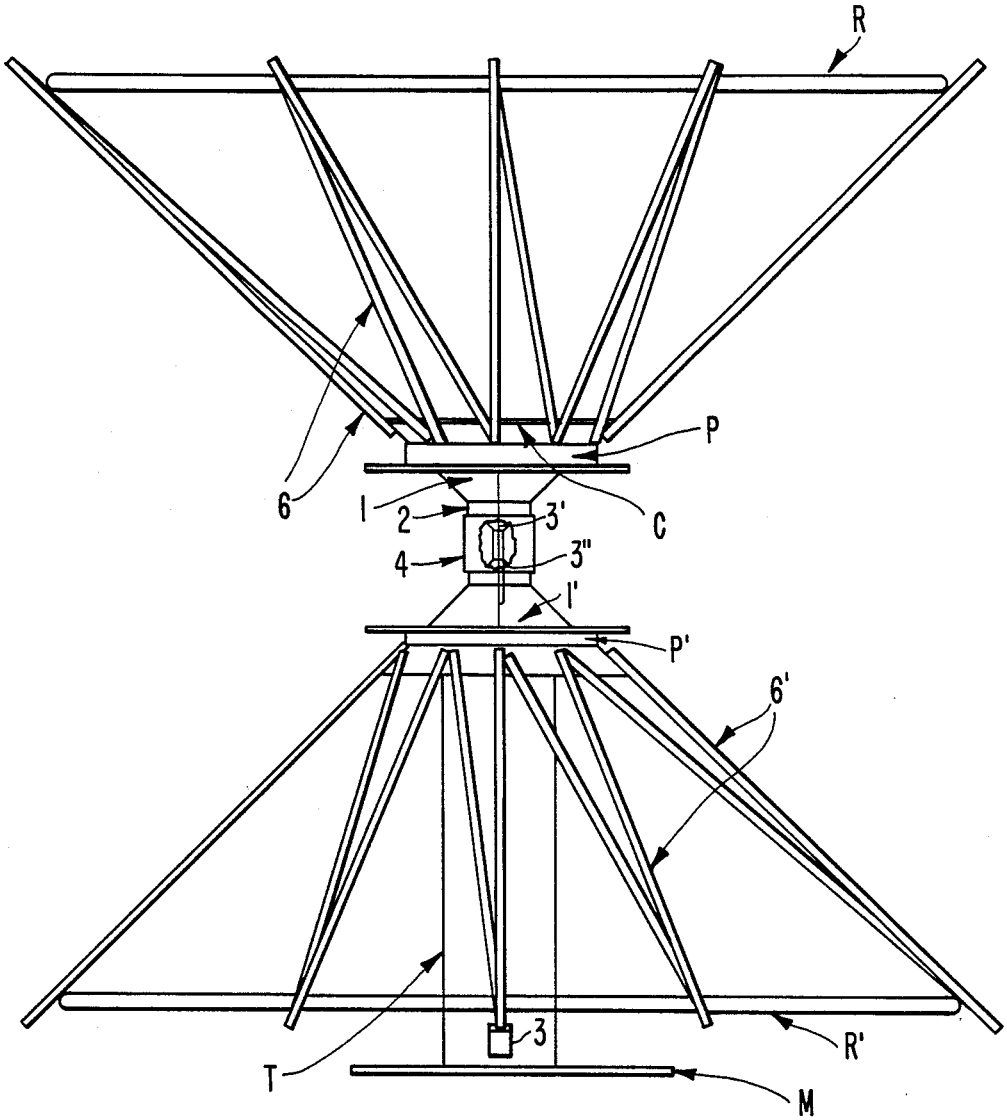

Referring to FIG. 1, the antenna is illustrated as biconical in configuration having an upper conductive cone 1 and an oppositely oriented lower cone 1', fed at the respective adjacent apex regions by the inner and outer conductors 3' and 3'' (180° or out-of-phase) of a preferred coaxial feed transmission line 3, shown in the broken-away central part of the antenna. The cone angle is shown as substantially 90°. The conical elements 1 and 1' are illustrated as held spaced apart by an insulating cylinder 2 of low-loss dielectric material, such as "Teflon" plastic or the like, surrounded by a conductive sleeve 4, such as a metal cylinder. The cylinder 4 capacitively couples the pair of cone elements 1 and 1' and serves as an outer conductor for the inner coaxial conductor 3' extending between cones 1' and 1, and prevents radiation from the inner conductor at the high frequencies, with adjustment thereof serving as a tuning ring and providing reactive tuning for the antenna that controls the voltage standing wave ratio over at least a portion of the broad band of frequencies with which the antenna is to operate. A conical crown comprises zig-zag conductive spokes or wires 6 and 6' that conically diverge and extend from the respective peripheries of the base edges of the solid cones 1 and 1' (substituting for extended solid cone structures), providing a plurality of serially connected inverted V-shaped thin spokes acting inductively, and with the gaps therebetween acting in a capacitive manner. The spoke sections 6, 6' by nature of their zig-zag uniformly distributed conical geometry all around the cone bases and the thin-spoke inverted V-shaped cross-sectional area shown, have been found to allow the antenna current to have a frequency dependent distribution which permits the current density to taper off as a function of the length of the antenna for increasing frequency—deliberately imbuing the antenna structure with frequency dependence. The resultant electrical aperture becomes therefore relatively constant as a function of frequency.

Figure 2:
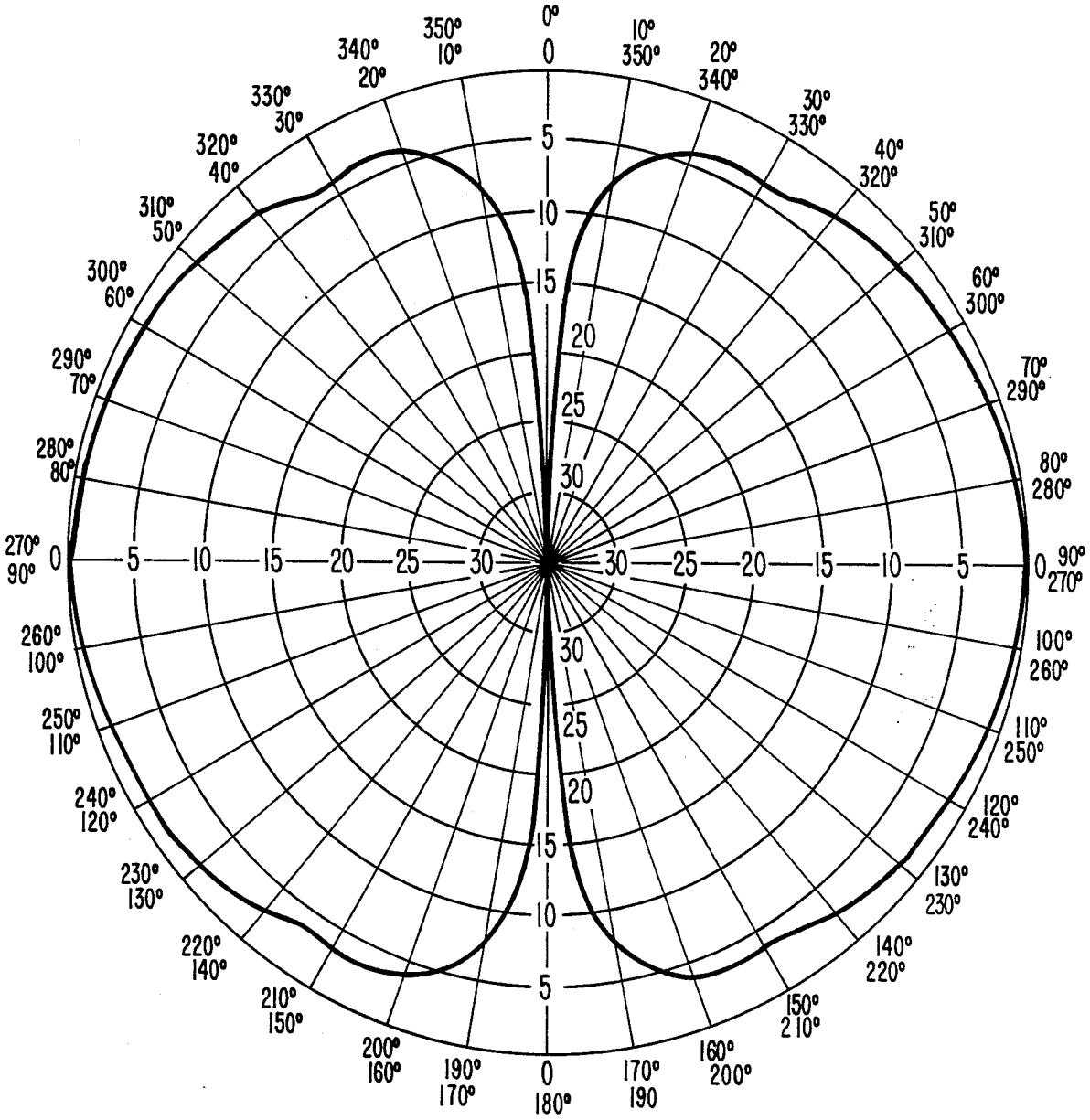
FIG. 2 is a polar plot of the type of broad elevational radiation pattern attainable with the antenna of the invention.

This critical feature forces the antenna elevation patterns to be relatively constant over a full 10:1 range for frequencies, a typical elevation plane radiation pattern being shown in FIG. 2 for operation at 1.3 GHz, with cones 1 and 1' of dimensions 15.0" diameter, and crowns of eight V-shaped spokes (6 and 6') of dimensions 10.6", spaced equally. The spoke structure tends to act as a resonant tank circuit, where, as before stated, the spoke or wire conductors 6, 6' are inductive, and the gaps between spokes act in a capacitive manner, the resulting tuned structure presenting an impedence which increases with increasing frequency. This causes the current density to be restricted to the center of the antenna at high frequencies and to be forced to a cosine distribution at low frequencies in the operating band, enabling remarkably constant elevational patterns and omnidirectional azimuthal patterns from 200 MHz to 2.0 GHz in the above example.

A rain or snow cover C is shown covering the upper cone 1. It may be of insulation or metal (since located inside the cones and thus carrying no currents); and the ends of the elements 6, 6' are held in fixed mechanically joined position with fixed separation by dielectric rings R, R'. It has further been found that annular conductive plates P, P', positioned around the respective cones 1, 1' near the central region of the antenna, as shown, aid in evening out impedance discontinuities at the lower frequencies through added capacitance thereat. The lower cone structure may be supported by, for example, an aluminum tube T upon a mounting plate M.

Modifications will occur to those skilled in the art and such are considered to fall within the spirit and scope of the invention as defined in the appended claims.

What is claimed is:

1. A broadband linearly polarized biconical antenna having, in combination, a pair of biconically disposed conductive cone elements with adjacent apex regions connected to out-of-phase terminals of a feed transmission line and spaced from one another by an insulating spacer; conductive sleeve means surrounding said spacer, capacitively coupling said cone elements, and providing reactance for the antenna so as to affect voltage standing wave ratios of the antenna over at least a portion of a broad band of frequencies; each cone element having crown means, including a zig-zag arrangement of conductive spokes that conically diverges from the periphery of a base of the cone element, for providing a plurality of V-shaped conductors that act inductively and that define a plurality of inter-spoke gaps that act capacitively, so as to provide a frequency-dependent antenna current distribution and an antenna impedance that increases with increasing frequency in said band, and so as to cause the antenna current density to be restricted to the center of the antenna at higher frequencies of said band and to be forced to a substantially cosine distribution at lower frequencies of said band.

2. A biconical antenna as claimed in claim 1, in which the transmission line is coaxial, the antenna is oriented vertically to provide vertical polarization, and the spokes provide substantially omni-directional radiation patterns in elevation over said broad band.

3. A biconical antenna as claimed in claim 2, in which each cone element has a vertex angle of substantially 90°.

4. A biconical antenna as claimed in claim 2, in which said conductive sleeve means prevents radiation from the transmission line feeding one of said cone elements at said higher frequencies.

5. A biconical antenna as claimed in claim 1, in which the insulating spacer is of low-loss dielectric material.

6. A biconical antenna as claimed in claim 1, in which each cone element has external annular plate means disposed between the apex and the base of the cone element for evening out impedance discontinuities at the lower frequencies.

7. A biconical antenna as claimed in claim 1, in which the V-shaped conductors of each crown means are mechanically joined to one another by dielectric ring means.

* * * * *